United States Patent [19]

Claiborne

[11] 4,135,034

[45] * Jan. 16, 1979

[54] SEWING THREAD CONTAINING A FLAME RETARDANT LUBRICANT

[75] Inventor: Jefferson L. Claiborne, Hexson, Tenn.

[73] Assignee: Dixie Yarns, Inc., Chattanooga, Tenn.

[ * ] Notice: The portion of the term of this patent subsequent to Oct. 25, 1994, has been disclaimed.

[21] Appl. No.: 802,560

[22] Filed: Jun. 1, 1977

Related U.S. Application Data

[63] Continuation of Ser. No. 657,058, Feb. 11, 1976, Pat. No. 4,054,715, which is a continuation-in-part of Ser. No. 612,546, Sep. 11, 1975, abandoned, which is a continuation of Ser. No. 455,362, Mar. 27, 1974, abandoned.

[51] Int. Cl.[2] ..... D02G 3/00

[52] U.S. Cl. ..... 428/375; 428/393; 428/394; 428/395; 428/921

[58] Field of Search ..... 428/375, 393, 394, 395, 428/921; 252/8.1, 8.6

[56] References Cited

U.S. PATENT DOCUMENTS

| | | | |
|---|---|---|---|
| 2,924,532 | 2/1960 | Dereich | 106/15 FP |
| 2,962,464 | 11/1960 | Feild | 260/28.5 A |
| 3,194,846 | 7/1965 | Blaga | 260/652.5 R |
| 3,284,361 | 11/1966 | Rocchini | 252/8.1 |
| 3,422,048 | 1/1969 | Cannelongo | 252/8.1 |
| 3,912,792 | 10/1975 | Touval | 252/8.1 |

*Primary Examiner*—Lorraine T. Kendell

*Attorney, Agent, or Firm*—Stevens, Davis, Miller & Mosher

[57] ABSTRACT

A flame-retardant yarn or thread containing a flame-retardant lubricant which consists of one or more mono- or di-chloro alkanes or one or more mono- or di-bromo alkanes, wherein the alkanes have ten to thirty carbon atoms.

6 Claims, 8 Drawing Figures

SEWING THREAD CONTAINING A FLAME RETARDANT LUBRICANT

CROSS REFERENCE TO RELATED APPLICATIONS

This application is a continuation of application Ser. No. 657,058, filed Feb. 11, 1976 now U.S. Pat. No. 4,054,715 which in turn was a continuation-in-part of application Ser. No. 612,546, filed Sept. 11, 1975 now abandoned, which in turn was a continuation of Ser. No. 455,362, filed Mar. 27, 1974, now abandoned.

BACKGROUND OF THE INVENTION

The present invention relates to lubricants for sewing threads and primarily to a nonflammable lubricant for use on a sewing thread employed in manufacturing nonflammable garments.

In the past, there have been a number of problems associated with the manufacture of nonflammable apparel, not the least of which related to the sewing thread employed in manufacturing such garmets. Sewing threads generally require some type of lubrication in order to sew properly and to protect the thread from deteriorating due to the heat of friction created as the thread passes through the needle of the sewing machine. Most lubricants known in the trade today, however, are flammable and even the small amount of lubricant used, which may constitute from 2 to 10% of the total weight of the sewing thread, is so flammable that flammability of the seam occurs with the result that the original object, i.e. to have a nonflammable garment, is for all practical purposes destroyed.

This problem is further complicated by the fact that sewing threads currently in use for manufacturing nonflammable garments are generally of synthetic materials which exhibit thermoplastic properties. Such threads require even better lubrication than natural threads to ensure against needle burn.

It is therefore necessary and desirable in the manufacture of nonflammable apparel, to employ a sewing thread lubricated with a nonflammable lubricant. Such nonflammable lubricants known to the inventor in the past have been ordinary lubricants such as esters, mineral oils, paraffins, and other fatty acid derivities which, although flammable in themselves, can be rendered nonflammable by the addition of fire-retardant materials such as compounds of halogens and phosphorous. These materials are only make-shifts, however, and the actual lubrication component is itself still flammable. Furthermore, the nonflammable portion of the combination generally has substantial nonlubricating properties which limits the lubrication value of the composite lubricant, since the nonflammable portion often comprises as much as 8 or 10% of the total mixture.

In view of these difficulties with known lubricants, it was desirable to find a lubricant that had both lubricating and flame-retardant properties. It was discovered by this inventor that certain halogenated alkanes had these properties, i.e. superior lubricity and inherent nonflammability.

SUMMARY OF THE INVENTION

Broadly stated, this invention comprises a flame-retardant yarn or thread primarily for use in sewing flame-retardant apparel and the like. The flame-retardant capability of the yarn or thread is imparted primarily by a flame-retardant lubricant which consists of one or more mono- or di- halo alkanes having from ten to thirty carbon atoms, where the halogen is either chlorine or bromine.

DESCRIPTION OF THE PREFERRED EMBODIMENT

Figure 1A:
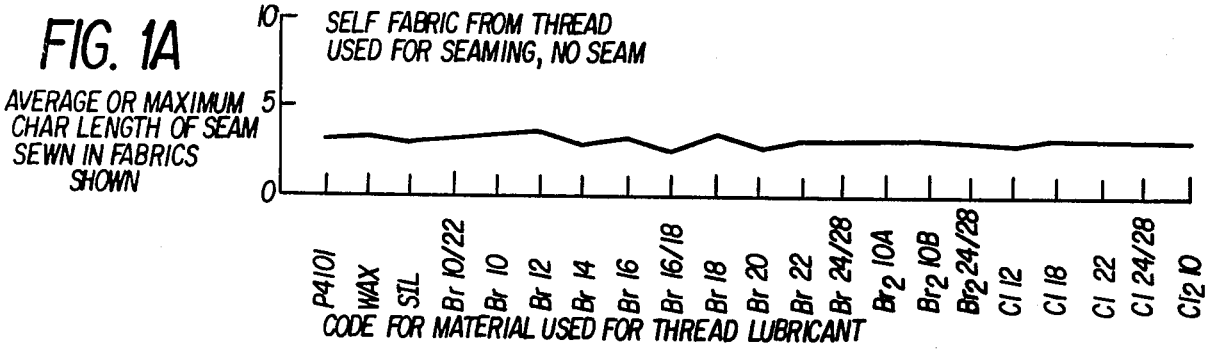
FIGS. 1A–1F are graphs (the ordinates and abscissas of which are all the same) of the mximum char length of a seam sewn in various fabrics with the lubricated sewing threads of this invention.
Figure 1B:
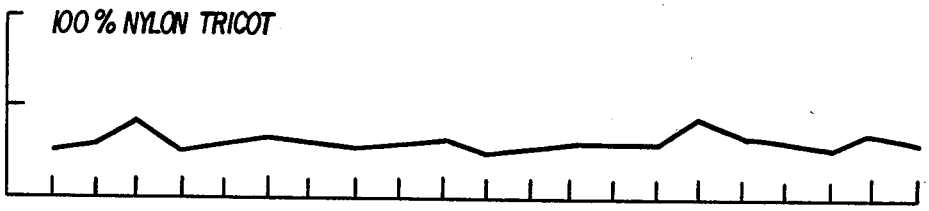
Figure 1C:
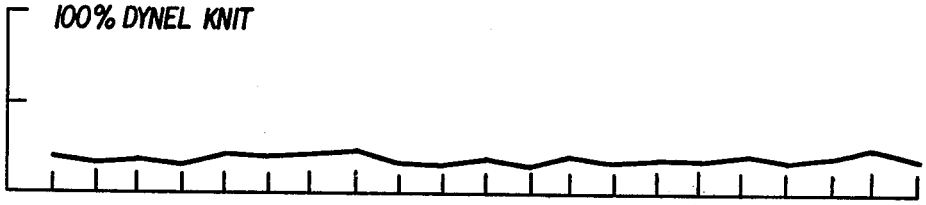
Figure 1D:
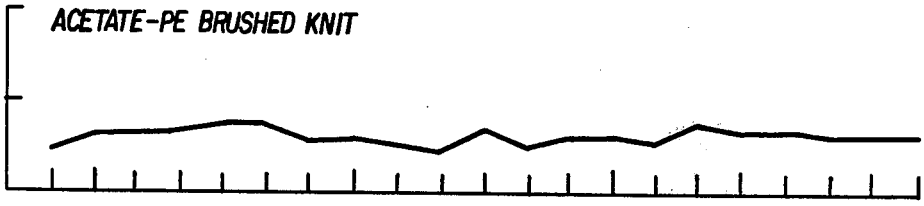
Figure 1E:
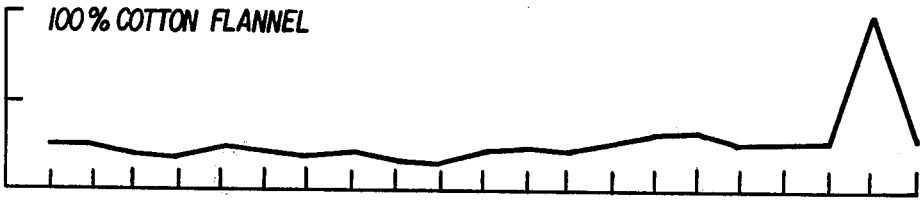
Figure 1F:
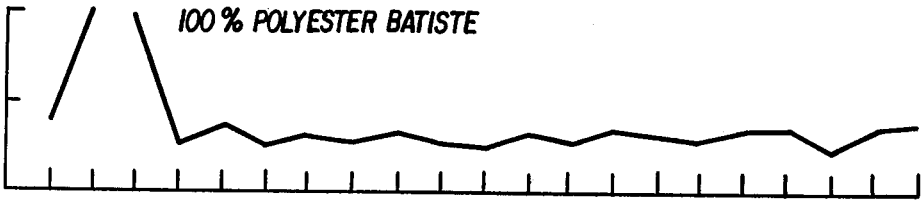

It was initially discovered by this inventor that brominated octadecane, and monobromo-octadecane in particular, had the desired properties for use as a flame-retardant lubricant for sewing threads.

Octadecane is a classic paraffin and is a lubricant in its own right because it happens to have those physical properties that make it a lubricant. It is a normal paraffin which is slick, like grease, but yet has certain other properties, such as the ability to disperse itself well along a thread structure and to be applied easily to thread to enhance the sewing capability of the thread. When bromine is attached to normal octadecane, the resulting compound becomes nonflammable because bromine is a well known fire retardant and its presence in almost any material in sufficient amounts will render an otherwise flammable compound nonflammable. It was also found that bromine in a compound with octadecane does not detract from the lubricating value of the latter, contrary to the addition of flame-retardant materials to other lubricants.

Thus bromo-octadecane can be applied to thread as is, with no further additions, from either a solvent application, the solvent being expected to evaporate before the possible introduction of flame, or from a hot melt by a kiss roll. Since octadecane melts at a fairly low temperature, it can be applied as a 100% compound from hot melt. In a preferred embodiment, the hot melt process was employed to topically apply the monobromo-octadecane to 100% polyester thread in an amount of 10% by weight of the thread. In general, the amount of lubricant applied depends on the type of sewing operation and is not critical although ranges of 2 to 10% by weight of the thread or yarn are common.

Subsequent experiments conducted by this inventor resulted in a finding that additional brominated or chlorinated alkanes, having a carbon chain length of from about 10 to about 30 carbon atoms, also had the desired lubricity and nonflammability properties. In the course of research conducted for this invention, the materials listed in TABLE I below were found to be particularly advantageous and useful.

TABLE I

| LUBRICANT MATERIAL | CODE |
|---|---|
| Mixed bromo alkanes $C_{10}$ thru $C_{22}$ | Br 10/22 |
| 1, bromo decane | Br 10 |
| 1, bromo dodecane | Br 12 |
| 1, bromo tetradecane | Br 14 |
| 1, bromo hexadecane | Br 16 |
| mixed bromo hexadecane & octadecane | Br 16/18 |
| 1, bromo octadecane | Br 18 |
| 1, bromo eicosane | Br 20 |

TABLE I-continued

| LUBRICANT MATERIAL | CODE |
|---|---|
| 1, bromo docosane | Br 22 |
| mixed brominated alkenes (avg. $C_{24}$ - $C_{28}$) | Br 24/28 |
| 1, 10, dibromo decane | $Br_2$ 10-A |
| 1, 2, dibromo decane | $Br_2$ 10-B |
| mixed dibrominated alkenes (avg. $C_{20}$ - $C_{24}$) | $Br_2$ 20/24 |
| mixed dibrominated alkenes (avg. $C_{24}$ - $C_{28}$) | $Br_2$ 24/28 |
| 1, chloro dodecane | Cl 12 |
| 1, chloro octadecane | Cl 18 |
| 1, chloro docosane | Cl 22 |
| mixed part. chlorinated alkenes (avg. $C_{24}$ - $C_{28}$) | Cl 21/28 |
| 1, 10, dichloro decane | $Cl_2$ 10 |

Among many others, one of the best methods for the preparation of alkyl bromides, albeit expensive, is the reaction of hydrobromic acid with the alcohol of the required alkyl compound. By this means, for example, octadecyl bromide can be obtained by the direct reaction of hydrobromic acid with octadecanol; this, in fact, is how much of the material used in the research for this invention was made.

A second method, more attractive economically and from the standpoint of obtaining raw materials more easily, is the bromination with pure bromine of an unsaturated material. Thus, for example, bromine will react directly with normal octadecene to produce both primary and secondary octadecyl bromide. The relative proportion of the primary and secondary bromide can be controlled by the reaction conditions.

Materials used in the research for this invention were made by both these methods. The raw materials used in these methods are available commercially; the alkyl halides used in this invention are manufactured by, for example, Humphrey Chemical Company, Devine Street, North Haven, Connecticut 06473.

The actual composition of mixed olefins is not always consistent, but generally it is a distribution of carbon chain lengths from very small amounts of the lower number through larger amounts of the principal numbers into smaller amounts of the larger numbers. For practical purposes, though, the mixed brominated alkenes simply result in mixed alkyl halides. The mixed bromo alkanes $C_{10}$ through $C_{22}$ (Br 10/22) was made from pure materials to show that a mixture of a number of various chain length halides also results in a usable material.

All of the lubricants listed in Table I can be applied to a sewing thread in the same manner as described above with respect to monobromo-octadecane.

Probably the most definite indication that these materials may be used as thread lubricants is in the actual application of the materials to 100% polyester spun sewing thread, that product being used to make seams. One of the measures of a lubricant for sewing thread would be the coefficient of friction produced by that thread as it passed over metal. Table II shows the amount of finish which was applied to a thread, and the coefficient of friction produced by passing that thread over a metal pin. Three known thread lubricants, Proctol 4101 (P4101), paraffin wax (wax), and dimethyl polysiloxane (SIL), were tested and compared with the flame-retardant lubricant materials of this invention. Proctol 4101, which is a commercially available material for threads suitable for flame-retardant sewing, and has been used by a large segment of the industry, is included as a control to show that the alkyl halides of this invention are equal to that material which is already used commercially. All of the coefficients of friction of the alkyl halides of this invention are in a range which would make acceptable lubricants; the new materials are, in many cases, better lubricants. To show that these materials may be applied from normal kiss roll applications in industrial practice, the viscosity of the materials are also shown in Table II.

TABLE II

| code | Amount of Finish Applied To Thread Sample | Coefficient of Friction | VISCOSITY CPS | VISCOSITY Temp (° C) |
|---|---|---|---|---|
| P4101 | 10.9% | 0.130 | 19.0 | 25 |
| wax | 17.0 | 0.098 | 17.0 | 190 |
| SIL | 8.8 | 0.119 | 359.7 | 25 |
| Br 10/22 | 3.4 | 0.082 | 11.5 | 25 |
| Br 10 | 10.6 | 0.111 | 8.0 | 25 |
| Br 12 | 11.9 | 0.101 | 11.0 | 25 |
| Br 14 | 13.2 | 0.098 | 12.0 | 25 |
| Br 16 | 6.8 | 0.102 | 12.5 | 25 |
| Br 16/18 | 11.8 | 0.122 | 12.5 | 25 |
| Br 18 | 10.2 | 0.095 | 2.4 | 100 |
| Br 20 | 9.3 | 0.087 | 3.2 | 100 |
| Br 22 | 11.4 | 0.162 | 3.9 | 100 |
| Br 24/28 | 10.6 | 0.074 | 6.2 | 100 |
| $Br_2$ 10-A | 11.6 | 0.123 | 10.0 | 25 |
| $Br_2$ 10-B | 11.8 | 0.136 | 11.0 | 25 |
| $Br_2$ 20/24 | 12.2 | 0.130 | | |
| $Br_2$ 24/28 | 12.7 | 0.136 | 7.2 | 100 |
| Cl 12 | 11.0 | 0.128 | 12.0 | 25 |
| Cl 18 | 12.5 | 0.107 | 16.0 | 25 |
| Cl 22 | 9.7 | 0.160 | 4.1 | 100 |
| Cl 24/28 | 11.9 | 0.145 | 6.0 | 100 |
| $Cl_2$ 10 | 11.8 | 0.127 | 15.0 | 25 |

In order to demonstrate that the materials of this invention do indeed contribute to the nonflammability of seams, sewn according to the Department of Commerce test number FF-3-71, seams were made in five different types of fabric used in commerce, and were subjected to char length (CL) and residual flame time (RFT) tests. A description of the flammability test method specified in DOC FF-3-71 can be found in Jakes et al, "A Primer on Seam Flammability", Bobbin, December, 1974. All of the seams were Stitch Type 503 and Seam Type SSal (described in Federal Standard No. 751*a*). Also, a fabric was made by knitting the sewing thread to demonstrate its nonflammable properties. The results of all of these tests can be seen in Table III. The test fabrics were:

A 100% polyester batiste
B Flame retardant 100% cotton flannel
C Flame retardant acetate brushed knit
D 100% dynel knit
E 100% nylon tricot
F Self fabric knitted from thread

TABLE III

| | A | | B | | C | | D | | E | | F | |
|---|---|---|---|---|---|---|---|---|---|---|---|---|
| Lubricant | CL | RFT | CL | RFT | CL | RFT | CL | RFT | CL | RFT | CL | RFT |
| P4101 | 3.5 | 2.5 | 2.4 | 0.0 | 2.4 | 0.0 | 1.8 | 0.0 | 2.7 | 0.0 | 3.1 | 0.0 |
| wax | *BEL | 25.5 | 2.4 | 0.0 | 3.2 | 0.0 | 1.5 | 0.0 | 3.0 | 20.5 | 3.3 | 0.0 |
| SIL | BEL | 85.0 | 2.0 | 0.0 | 3.3 | 0.0 | 1.6 | 0.0 | 2.9 | 27.0 | 2.9 | 27.0 |
| Br 10/22 | 2.7 | 9.0 | 1.8 | 0.0 | 3.4 | 0.0 | 1.5 | 0.0 | 2.6 | 7.0 | 3.0 | 0.0 |
| Br 10 | 3.5 | 8.0 | 2.3 | 0.0 | 3.8 | 0.0 | 1.8 | 0.0 | 2.9 | 0.0 | 3.3 | 0.0 |
| Br 12 | 2.6 | 2.0 | 2.1 | 0.0 | 3.7 | 0.0 | 1.8 | 0.0 | 3.2 | 0.0 | 3.4 | 0.0 |
| Br 14 | 3.0 | 1.0 | 1.8 | 0.0 | 2.8 | 7.0 | 2.0 | 0.0 | 2.9 | 0.0 | 2.7 | 0.0 |

TABLE III-continued

| | A | | B | | C | | D | | E | | F | |
|---|---|---|---|---|---|---|---|---|---|---|---|---|
| Lubricant | CL | RFT | CL | RFT | CL | RFT | CL | RFT | CL | RFT | CL | RFT |
| Br 16 | 2.8 | 2.0 | 1.9 | 0.0 | 2.9 | 0.0 | 2.2 | 0.0 | 2.8 | 3.0 | 3.1 | 0.0 |
| Br 16/18 | 3.2 | 13.0 | 1.5 | 1.5 | 2.5 | 0.0 | 1.5 | 0.0 | 3.1 | 6.5 | 2.4 | 0.0 |
| Br 18 | 2.6 | 1.0 | 1.5 | 0.0 | 2.3 | 3.0 | 1.4 | 0.0 | 3.3 | 10.0 | 3.3 | 0.0 |
| Br 20 | 2.4 | 2.0 | 1.9 | 0.0 | 3.4 | 1.5 | 1.7 | 0.0 | 2.5 | 0.0 | 2.6 | 0.0 |
| Br 22 | 3.0 | 0.0 | 2.2 | 0.0 | 2.5 | 0.0 | 1.5 | 0.0 | 2.8 | 0.0 | 2.9 | 0.0 |
| Br 24/28 | 2.7 | 1.5 | 2.1 | 1.0 | 2.8 | 1.0 | 1.8 | 0.0 | 3.0 | 1.5 | 2.9 | 0.0 |
| $Br_2$10-A | 3.2 | 8.0 | 2.5 | 2.0 | 3.0 | 2.0 | 1.6 | 0.0 | 3.0 | 0.0 | 3.0 | 0.0 |
| $Br_2$10-B | 3.0 | 0.0 | 3.0 | 0.0 | 2.8 | 0.0 | 1.7 | 0.0 | 2.9 | 0.0 | 3.1 | 0.0 |
| $Br_2$24/28 | 2.8 | 0.0 | 3.0 | 0.0 | 3.6 | 0.0 | 1.8 | 0.0 | 4.2 | 41.0 | 2.9 | 0.0 |
| Cl 12 | 3.2 | 9.0 | 2.3 | 1.5 | 3.2 | 0.0 | 1.9 | 0.0 | 3.3 | 0.0 | 2.8 | 0.0 |
| Cl 18 | 3.4 | 13.5 | 2.5 | 1.5 | 3.2 | 17.5 | 1.6 | 0.0 | 2.9 | 3.0 | 3.1 | 0.0 |
| Cl 22 | 2.1 | 1.5 | 2.6 | 2.0 | 2.9 | 29.0 | 1.7 | 0.0 | 2.8 | 13.0 | 3.1 | 0.0 |
| Cl 24/28 | 3.2 | 0.0 | BEL | 0.0 | 3.0 | 0.0 | 2.2 | 0.0 | 3.5 | 0.0 | 3.1 | 0.0 |
| $Cl_2$ 10 | 3.6 | 17.0 | 2.3 | 2.0 | 3.0 | 2.0 | 1.8 | 0.0 | 3.1 | 2.0 | 3.0 | 0.0 |

CL = CHAR LENGTH (inches)
RFT = RESIDUAL FLAME TIME (seconds)
*BURNED ENTIRE LENGTH In the Department of Commerce test, one of the reasons for failure is the char length. Normally, out of a five specimen burning, no char length can be greater than the entire length of the sample, which is ten inches, nor can the average of the five be greater than seven inches. Therefore, the average char length can be used as an indication of the effectiveness of nonflammability of thread finishes. It can be seen from the graphs of FIGS. 1A-F that, in most of the fabrics tried, the thread is of such little importance that it has no pronounced effect on seam flammability. However, in the 100% nylon tricot, and 100% polyester batiste, the lubricants which do not have nonflammable properties (i.e., wax and SIL) exhibit a detrimental effect on the flammability of the seam.

Figure 2:
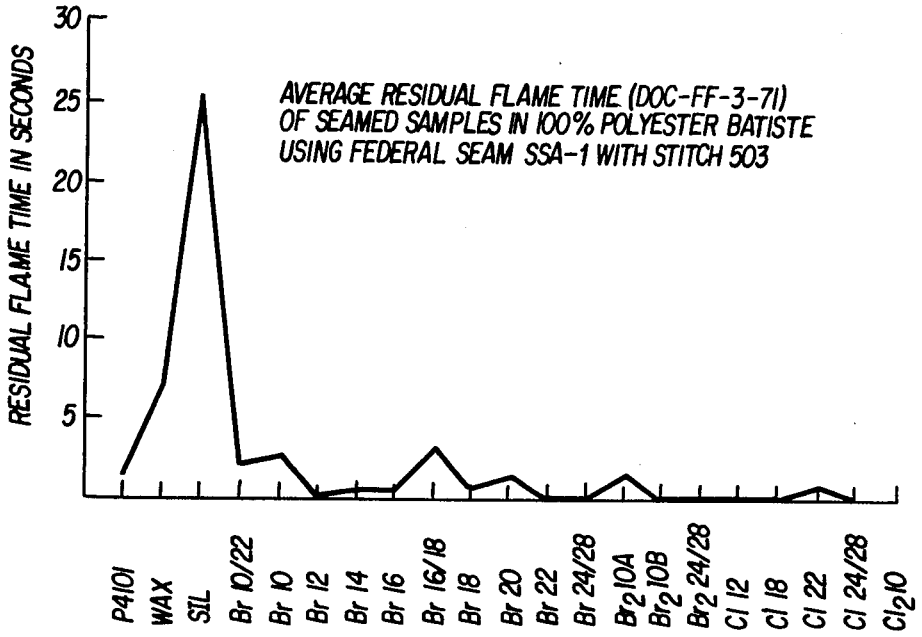
FIG. 2 is a graph of the average residual flame time of a 100% polyester batiste fabric seamed with the lubricated sewing threads of this invention.
Figure 3:
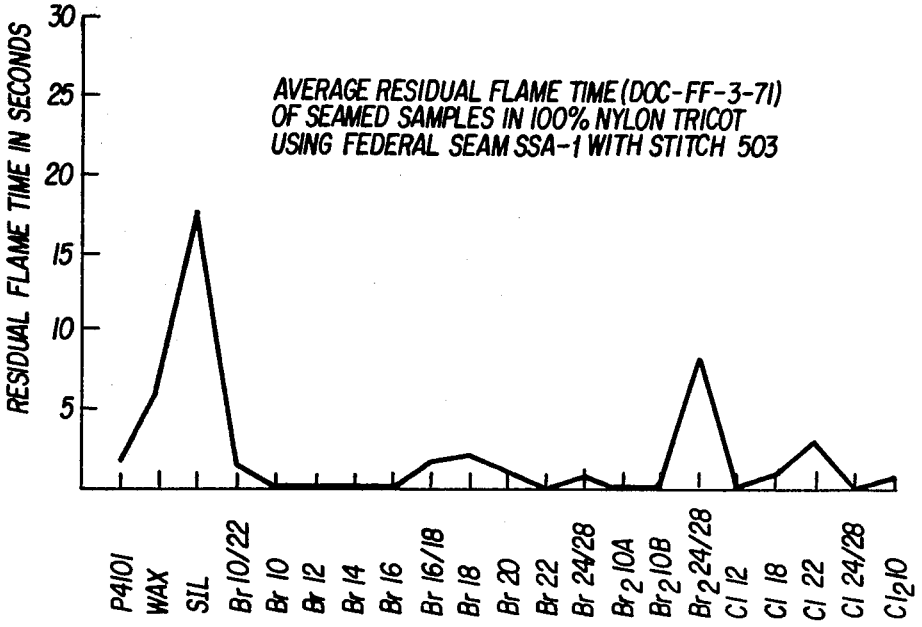
FIG. 3 is a graph of the average residual flame time of a 100% nylon tricot fabric seamed with the lubricated sewing threads of this invention.

Another indication of flammability under DOC FF-3-71 is residual flame time, which is the actual time that the flame continues in the drip after the removal of the ignition. In order to demonstrate the effectiveness of the flame-retardant lubricants of this invention, FIGS. 2 and 3 show the average residual flame times for the two fabrics already demonstrated to be criticial. These clearly indicated that waxy materials, or silicone, which are commonly used, are unsatisfactory for use as flame-retardant lubricants for threads seaming these materials.

At this point, it is important to point out that, in many fabrics, the nonflammable properties of the fabric itself are sufficient to counteract any flammability of the thread used in the seaming of these fabrics. This means that, for many purposes, threads of any description would be found suitable, at least statistically. However, in critical fabrics, the use of a thread with nonflammable lubricant is indicated, and of course, this lubricant is always indicated when sewing garments of a nonflammable nature, since the influence of thread and seams is never clear-cut enough to positively determine beforehand that a thread of a flammable nature may be used.

It should also be pointed out that it is well-known in the trade, especially after being demonstrated in work done by Spivak et al at the University of Maryland, on the seaming of nonflammable garments, that the actual type of seam, the density of the resulting seam, the type of stitch and the density of thread in the stitch, also affect flammability. There are other types of seams in which thread is even more critical, those being seams in which the proportion of thread to fabric becomes very large, such as a "flatlock". In these cases, the use of a sewing thread treated with a flame-retardant lubricant may be particularly important.

It is to be understood that various modifications in the structural details of the preferred embodiment described herein may be made within the scope of this invention and without departing from the spirit thereof. It is intended that the scope of this invention shall be limited solely by the hereafter appended claims.

What is claimed is:

1. A flame-retardant sewing thread, comprising a sewing thread having applied thereto a flame-retardant lubricant selected from the group consisting of straight chain mono- and di- chloro alkanes having from 10 to about 30 carbon atoms.

2. A flame-retardant sewing thread as claimed in claim 1, said flame-retardant lubricant having from 10 to about 28 carbon atoms.

3. A flame-retardant sewing thread as claimed in claim 2, wherein said lubricant consists of one member of the group of mono-chloro alkanes having from about 12 to about 22 carbon atoms.

4. A flame-retardant sewing thread as claimed in claim 2, wherein said lubricant consists of mixed mono-chloro alkanes having from about 24 to about 28 carbon atoms.

5. A flame-retardant sewing thread as claimed in claim 2, wherein said lubricant consists of a di-chloro alkane having 10 carbon atoms.

6. A flame-retardant sewing thread according to claim 5, wherein said alkane is a 1, 10 di-chloro decane.

* * * * *